US011446734B2

(12) United States Patent
Richaud et al.

(10) Patent No.: US 11,446,734 B2
(45) Date of Patent: Sep. 20, 2022

(54) CASTING NOZZLE

(71) Applicant: VESUVIUS GROUP, S.A., Ghlin (BE)

(72) Inventors: Johan Richaud, Cheval Blanc (FR); Waldemar Heinbichner, Borken (DE)

(73) Assignee: Vesuvius Group, S.A., Ghlin (BE)

( * ) Notice: Subject to any disclaimer, the term of this patent is extended or adjusted under 35 U.S.C. 154(b) by 0 days.

(21) Appl. No.: 17/613,109

(22) PCT Filed: May 22, 2020

(86) PCT No.: PCT/EP2020/064266
§ 371 (c)(1),
(2) Date: Nov. 22, 2021

(87) PCT Pub. No.: WO2020/234447
PCT Pub. Date: Nov. 26, 2020

(65) Prior Publication Data

US 2022/0250142 A1 Aug. 11, 2022

(30) Foreign Application Priority Data

May 23, 2019 (EP) ..... 19176155

(51) Int. Cl.
*B22D 41/50* (2006.01)

(52) U.S. Cl.
CPC ..... *B22D 41/50* (2013.01)

(58) Field of Classification Search
CPC ..... B22D 41/50
See application file for complete search history.

(56) References Cited

U.S. PATENT DOCUMENTS

| | | | |
|---|---|---|---|
| 4,819,840 | A | 4/1989 | Lax et al. |
| 5,785,880 | A | 7/1998 | Heaslip et al. |
| 5,944,261 | A | 8/1999 | Heaslip et al. |
| 6,027,051 | A | 2/2000 | Heaslip et al. |
| 6,464,154 | B1 | 10/2002 | Heaslip et al. |

(Continued)

FOREIGN PATENT DOCUMENTS

| | | | |
|---|---|---|---|
| CA | 2018079 | C | 12/1990 |
| CN | 87104752 | A | 3/1988 |

(Continued)

OTHER PUBLICATIONS

International Search Report for PCT/EP2020/064266, dated Aug. 25, 2020.

(Continued)

*Primary Examiner* — Kevin E Yoon
(74) *Attorney, Agent, or Firm* — Blue Filament Law PLLC

(57) ABSTRACT

A casting nozzle for use in the casting of molten metal produces a stable flow pattern having an elongated section in the horizontal plane. The bore cross-sectional area contains, from entry to exit, at least two significant section area reductions to reduce turbulence, realign streamlines and affect flow distribution inside the nozzle. The bore cross-section has a local minimum value in a contraction section located between the entry section and an expansion section. Bore cross-sectional area decreases from the expansion section to the lower end of the nozzle. The two significant cross-sectional area reductions cooperate with other structures within the bore to stabilize flow.

14 Claims, 7 Drawing Sheets

(56) References Cited

U.S. PATENT DOCUMENTS

| | | | | |
|---|---|---|---|---|
| 8,584,911 | B2 * | 11/2013 | Morales | B22D 41/50<br>266/236 |
| 9,156,084 | B2 | 10/2015 | Guastini et al. | |
| 2001/0038045 | A1 | 11/2001 | Heaslip et al. | |
| 2006/0243760 | A1 | 11/2006 | McIntosh et al. | |

FOREIGN PATENT DOCUMENTS

| | | | |
|---|---|---|---|
| CN | 1047819 | A | 12/1990 |
| CN | 1283535 | A | 2/2001 |
| CN | 2770832 | Y | 4/2006 |
| CN | 111974981 | A | 11/2020 |
| CN | 214161385 | U | 9/2021 |

OTHER PUBLICATIONS

ISIJ Morales Design of a Submerged Entry Nozzle for Thin Slab Molds Operating at High Casting Speed.

* cited by examiner

CASTING NOZZLE

CROSS-REFERENCE TO RELATED APPLICATIONS

This application is the National Stage application of International Application No. PCT/EP2020/064266, filed May 22, 2020, which claims the benefit of European Patent Application No. EP 19176155.0, filed May 23, 2019.

FIELD OF THE INVENTION

This invention relates generally to a refractory article and, more particularly, to a refractory pour tube for use in the transfer of molten metal in a continuous casting operation.

BACKGROUND OF THE INVENTION

In the continuous casting of metal, particularly steel, a stream of molten metal is typically transferred via a refractory pour tube from a first metallurgical vessel into a second metallurgical vessel or mold. Such tubes are commonly referred to as nozzles or shrouds and possess a bore adapted to transfer molten metal. Pour tubes include submerged-entry nozzles (SEN) or submerged-entry shrouds (SES), which discharge molten metal below the liquid surface of a receiving vessel or mold.

Liquid metal is discharged from the downstream end of the bore through one or more outlet ports. One important function of a pour tube is to discharge the molten metal in a smooth and steady manner without interruption or disruption. A smooth, steady discharge facilitates processing and can improve the quality of the finished product. Controlling the discharge may entail reduction of turbulence, stabilization of exit jets, and achievement of a desired discharge angle for independent streams. A second important function of a pour tube is to establish proper dynamic conditions within the liquid metal in the receiving vessel or mold in order to facilitate further processing. Producing proper dynamic conditions may require the pour tube to possess a plurality of exit ports that are arranged so as to cause the stream of molten metal to be turned in one or more directions upon discharge from the tube, or to induce a desired flow pattern in the molten metal to which the stream is being introduced.

Thin slab casting is a process in which steel is cast directly to slabs typically having a thickness from 30 mm to 60 mm and widths from 800 mm to 1600 mm. In the slab casting process, molten steel is poured from a ladle into a tundish at the top of a slab caster. The molten steel passes at a controlled rate into a caster, in which the outer surface of the steel solidifies in a water cooled mould. Because of the caster geometry, and to allow for tight clearances, the refractory pour tube is configured so that the lower portion has a geometry in which one horizontal dimension is significantly larger than the other. It is advantageous to deliver liquid metal to a mold in one or more streams with an overall elongated cross-section oriented to conform to the configuration of the mold.

It is known in the art to make use of casting nozzles having a main transition from circular cross-section containing a flow of axial symmetry, to an elongated cross-section with a thickness which is less than the diameter of the circular cross-section and a width which is greater than the diameter of the circular cross-section containing a flow of planar symmetry with generally uniform velocity distribution throughout the transition neglecting wall friction.

Also known is the use of baffles within casting nozzles to proportion the flow divided between outer streams and a central stream.

Reference D1 (CN2770832Y, LUOYANG REFRACTORY MATERIAL IN [CN]) relates to a submersible nozzle for sheet billet continuous casting. The nozzle comprises an elongated bore having a central axis comprising, in descending order from the top of the bore, an entry section, a contraction section, an expansion section, and an adjustment section. Examples are disclosed in which a flow divider is disposed within the bore at the lower end of the nozzle. Examples in which each of a pair of baffles is positioned between the flow divider and a respective side wall are not disclosed.

Reference D2 (US2001/038045 to Heaslip et al.) relates to a method and apparatus for flowing liquid metal through a casting nozzle. The nozzle comprises an elongated bore. Examples are disclosed in which a flow divider is disposed within the bore at the lower end of the nozzle, and in which each of a pair of baffles is positioned between the flow divider and a respective side wall. Examples in which each of a pair of baffles is positioned between the flow divider and a respective side wall, and in which the baffles extend upwardly from an exit port to the top of an adjustment section, are not presented.

Reference D3 (US 2006/243760 McIntosh et al.) relates to a nozzle for transferring molten steel in a thin slab continuous casting machine from the tundish to the mold which provides at least two areas of stream compression below the major changes in section required to transition from the entry diameter to the rectangular submerged portion of the nozzle. The nozzle comprises an elongated bore having a central axis comprising, in descending order from the top of the bore, an entry section, a contraction section, an expansion section, and an adjustment section. Examples are disclosed in which a flow divider is disposed within the bore at the lower end of the nozzle. Examples in which each of a pair of baffles is positioned between the flow divider and a respective side wall, and in which the baffles extend upwardly from an exit port to the top of an adjustment section, are not presented. Examples in which the baffles have a greater upward extent than the flow divider are not presented.

Problems associated with refractory pour tubes for casting operations include the presence of turbulence and the associated entrainment of slag and the incorporation of the slag into the body of the metal melt. Another problem encountered is nonuniformity of the flow pattern along the longer dimension of the exit of the refractory pour tube. Still another problem encountered is the production of long discharging jets from the refractory pour tube; these may become unstable and may be subject to wandering. In general, in wide nozzles the flow distribution is not optimal, and the liquid fluctuates within the nozzle. This will cause severe bias flows, in which there will be more liquid output through one exit port than through the other. At high casting speed, this flow asymmetry can cause vortexing around the nozzle along the meniscus and also hot delivery along one side of the mold. A need therefore exists for a refractory pour tube providing improved flow stability and improved flow distribution.

BRIEF SUMMARY OF THE INVENTION

The present invention relates to a casting nozzle for use in the casting of molten metal. The pour tube contains at least four exit ports and, relative to prior art, provides a stable flow pattern having an elongated section in the horizontal plane.

The technical solution is achieved by a particular configuration of the cross-sectional area for the bore or casting channel of a nozzle. The bore cross-sectional area contains, from entry to exit, at least two significant cross-sectional area reductions to reduce turbulence, realign streamlines and affect flow distribution inside the nozzle. From upper end to lower end, the bore contains an entry section, a contraction section, an expansion section and an adjustment section. The bore cross-section has a local minimum value in a contraction section located between the entry section and an expansion section. Bore cross-sectional area decreases from the expansion section/adjustment section boundary to the lower end of the nozzle. The two significant cross-section area reductions may cooperate with other structures to achieve the technical solution. One cooperating structure is the combination of a flow divider, located at the bottom of the refractory pour tube along the central vertical axis of the bore, with baffles located between the flow divider and respective side walls, to form a pair of exit ports on each side of the central vertical axis of the bore. In certain configurations of this structure, all walls of each exit port extend to the bottom surface of the casting nozzle. Another cooperating structure is the configuration of exit ports that direct flow, on each side of the central vertical axis of the bore, away from the central vertical axis at the same angle. Another cooperating structure is the arrangement of the baffles and the flow divider so that flow within the casting nozzle is directed away from the central vertical axis of the bore and towards the sides of the casting nozzle. Another cooperating structure is the coincident position of the upper ends of the baffles and the intersection of the expansion section and adjustment section of the nozzle. Another cooperating structure is the mathematical relationship between the distance between the upper ends of each of a pair of baffles, and the minimum distance between each respective baffle and a respective side wall. Another cooperating structure is the beveling of the lower end of the nozzle so that the distance from the intersection of the expansion section and adjustment section of the nozzle for exit ports in communication with the interior of a side wall to the exterior of the nozzle at its lower end is shorter than the distance from the intersection of the expansion section and adjustment section of the nozzle for exit ports in communication with a lateral wall of the flow divider to the exterior of the nozzle at its lower end.

The nozzle has a lower end, an exterior surface, and an elongated bore having a central vertical axis, the bore having an upper end and a lower end, the bore having at least one entry port disposed at the upper end and at least one exit port disposed at the lower end.

The elongated bore contains an entry section disposed at the upper end of the bore, the entry section having an upper end, a lower end, and a uniform cross-sectional area. The elongated bore contains a contraction section disposed below, and in direct communication with, the entry section; the contraction section having an upper end, a lower end, a cross-sectional area at the upper end being equal to the cross-sectional area of the entry section, and a cross-sectional area that decreases from the upper end to the lower end of the section. The elongated bore contains an expansion section disposed below, and in direct communication with, the contraction section; the expansion section having an upper end, a lower end, a cross-sectional area at the upper end being equal to the cross-sectional area of the lower end of the contraction section and less than the cross-sectional area of the entry section, a cross sectional area that increases from the upper end to the lower end; and a cross-sectional area at the lower end being greater than the cross-sectional area of the entry section. The elongated bore contains an adjustment section disposed below, and in direct communication with, the expansion section; the adjustment section having an upper end, a lower end, a length, a cross-sectional area at the upper end being equal to the cross-sectional area of the of the lower end of the expansion section and greater than the cross-sectional area of the entry section, a cross-sectional area that decreases from the upper end to the lower end. The cross-sectional area at the lower end may be in the range from and including 80% to and including 120% of the cross-sectional area of the entry section, or in the range from and including 100% to and including 120% of the cross-sectional area of the entry section, or may be larger than the cross-sectional area of the entry section. The cross-sectional area of the elongated bore at the lower end of the casting nozzle may be characterized as the sum of (a) the cross-sectional area of each exit port in the plane orthogonal to the central vertical axis and containing the lower end of the nozzle, and (b) the projected cross-sectional area, in the plane orthogonal to the central vertical axis, of each exit port not extending to the plane orthogonal to the central vertical axis and containing the lower end of the nozzle.

The minimum cross-sectional area of the contraction section may have a value in the range from and including 60% to and including 90% of the cross-sectional area of the entry section.

The maximum cross-sectional area of the expansion section may have a value in the range from and including 150% to and including 200% of the cross-sectional area of the entry section, or may have a value in the range from and including 160% to and including 170% of the cross-sectional area of the entry section.

The contraction section, expansion section and the adjustment section may comprise a pair of opposing face walls having interiors and exteriors and a pair of opposing side walls having interiors and exteriors, with the distance between the opposing side walls being greater than the distance between the opposing face walls, and with the distance between the opposing side walls increasing from the upper end to the lower end of the expansion section. The distance between the opposing side walls may increase by a factor of 2 or by a factor of at least 2, from the upper end of the expansion section to the lower end of the expansion section. The contraction section and the adjustment section may both be located within the half of the bore proximal to the lower end of the nozzle. The width of the bore may increase, in the contraction section, at least 20% from the upper end of the contraction section to the lower end of the contraction section.

According to a generalized description, the article comprises a nozzle having a bore comprising an adjustment section, adjacent to one or more exit ports, that diminishes in cross-sectional area with respect to the downward extent of the bore.

The casting nozzle may also contain a flow divider and baffles. In one configuration, a flow divider is disposed within the bore, at the lower end of the casting nozzle, on the central vertical axis of the bore, between the pair of opposing face walls, and a pair of baffles is positioned within the bore, each baffle positioned between the flow divider and a respective side wall, the lower end of each baffle forming a portion of the exterior surface of the casting nozzle, each baffle extending inwardly from at least one face wall, the pair of baffles being positioned symmetrically with respect to the central vertical axis of the elongated bore. The flow divider may comprise a pair of lateral walls; each lateral wall facing a respective adjustment section side wall, the pair of lateral walls being positioned symmetrically with respect to the central vertical axis of the elongated bore. Each baffle may comprise an upper end, a lower end, outward-facing longitudinal wall and an inward-facing longitudinal wall. The outward-facing wall of each baffle defines, in conjunction with a respective casting nozzle side wall interior and the interiors of opposing nozzle face walls, a lateral exit port; The inward-facing wall of each baffle defines, in conjunction with a respective lateral wall of the flow divider and the interiors of opposing nozzle face walls, a central exit port. The flow divider may comprise a concave upper surface. The size of the divider may be such that the flow entering between the baffles is restricted when exiting the region comprised between the baffles and the central divider.

In configurations in which a flow divider and baffles are present, the flow divider may contain an exit port channel extending from the adjustment section to the exterior of the casting nozzle, with the flow divider exit port channel having a diameter of (d0). In such configurations, the minimum distance between the first baffle and the second baffle, or the distance between the upper ends of the first baffle and the second baffle (d), and the minimum distance between each baffle and a respective side wall (d2), may be expressed by the formula $(d)/2<d2<2(d/2)$. In such configurations, the minimum distance between the first baffle and the second baffle (d), the diameter (d0) of the flow divider exit port channel, and the minimum distance between each baffle and the flow divider (d1), may be expressed by the formula $0.8(d)/2<((d1)+(d0))<2(d)/2$.

The angle (beta) described, in the vertical plane orthogonal to the outward-facing longitudinal surface of each baffle, by the outward-facing longitudinal surface of each baffle and the central vertical axis of the bore of the nozzle, may have a value from and including 6 degrees to and including 18 degrees, and may have a value of any of 6, 7, 8, 9, 10, 11, 12, 13, 14, 15, 16, 17, and 18 degrees.

The outward-facing longitudinal surface of each baffle, the inward-facing longitudinal surface of each baffle, the corresponding lateral surface of the flow divider, and the interior of the corresponding side wall may be parallel at their intersection with the exit ports they form. Configurations in which an outward-facing longitudinal surface of a baffle curves outwardly from the upper end of the baffle to the lower end may be excluded from configurations of the casting nozzle.

The entry section, contraction section, expansion section, and adjustment sections of the nozzle may have specified lengths with respect to the entire length of the nozzle. The length of the contraction section has a value from and including 5% to and including 15% of the length of the casting nozzle. The length of the expansion section may have a value from and including 20% to and including 50% of the length of the casting nozzle. The length of the adjustment section may have a value from and including 5% to and including 15% of the length of the casting nozzle.

The lower end of the casting nozzle may be composed of a central planar surface orthogonal to the central vertical axis of the bore of the nozzle, from which two planar surfaces each extending upwardly and away from the central planar surface to a respective side wall of the casting nozzle. This configuration might alternatively be described as the formation of two beveled surfaces at the intersection of each side wall with the lower end of the nozzle. The beveled surfaces may contain exit ports and thus contain lower ends of the nozzle bore. The angle (alpha) formed by a beveled surface with the plane orthogonal to the central vertical axis and containing the lower end of the nozzle may have a value in the range from and including 30 degrees to and including 60 degrees, or from and including 40 degrees to and including 50 degrees.

DETAILED DESCRIPTION OF THE INVENTION

Figure 1:
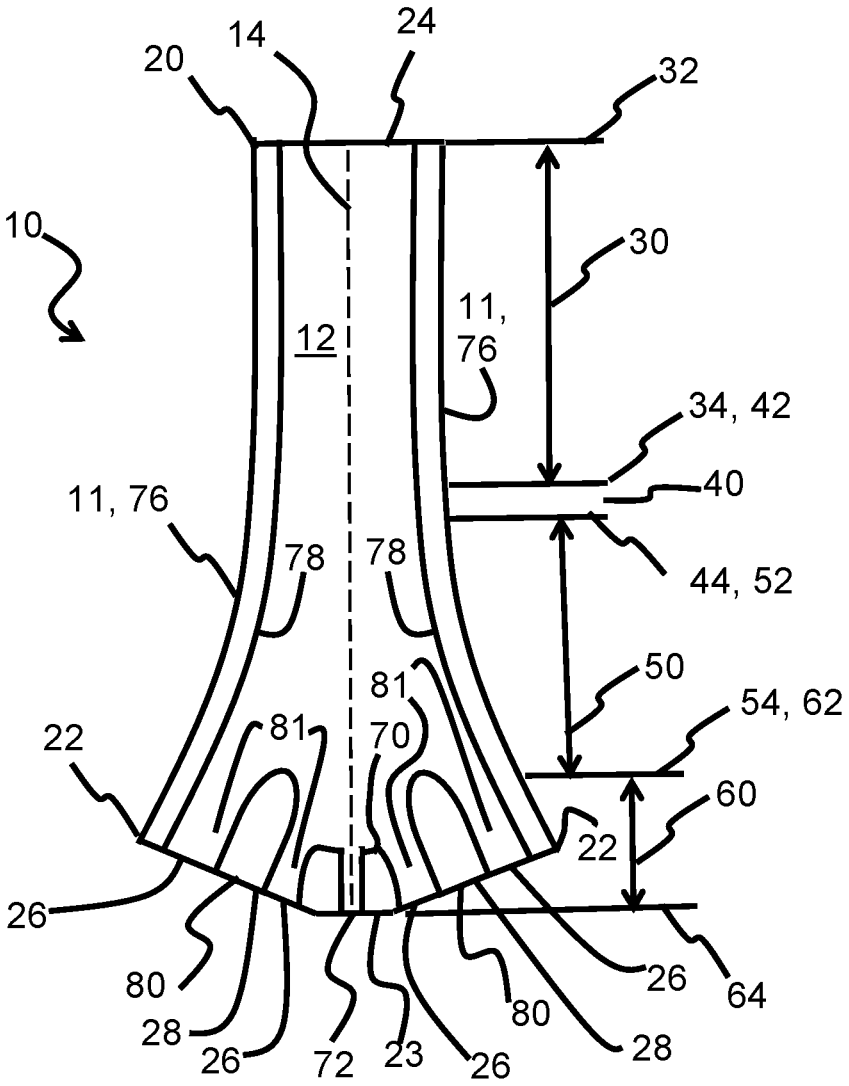
FIG. 1 is a schematic representation of a nozzle of the present invention.

FIG. 1 shows a view, along a vertical section, of a casting nozzle 10. The casting nozzle 10 comprises a casting nozzle exterior surface 11 surrounding a casting nozzle bore 12 having a central longitudinal or vertical axis 14. The nozzle bore 12 extends from upper end 20 of the casting nozzle to lower end 22 of the casting nozzle bore, wherein lower end 22 of the casting nozzle bore may contain or adjoin casting nozzle lower end 23. Nozzle bore 12 fluidly connects entry port 24 at the upper end 20 of casting nozzle 10 to one or more exit ports 26 at the lower end 22 of casting nozzle bore 12. Exit ports 26 may be contained in one or more exit port faces 28, which may have an angle with the horizontal.

Nozzle bore entry section 30 extends downwardly from entry section upper end 32, located in proximity to the upper end 20 of the casting nozzle, to entry section lower end 34, where the entry section 30 is in communication with contraction section 40. Nozzle bore contraction section 40 extends downwardly from contraction section upper end 42 to contraction section lower end 44, where the contraction section 40 is in communication with expansion section 50.

Nozzle bore expansion section 50 extends downwardly from expansion section upper end 52 to expansion section lower end 54, where the expansion section is in communication with adjustment section 60. Nozzle bore adjustment section 60 extends downwardly from adjustment section upper end 62 to adjustment section lower end 64, which corresponds to lower end 23 of the casting nozzle.

Flow divider 70, located in proximity to the lower end 22 of the casting nozzle, divides the flow of molten metal descending in proximity to central vertical axis 14 into two streams; each stream passes through an exit port 26. Flow divider exit port channel 72 passes longitudinally or vertically through flow divider 70 from adjustment section 60 to the exterior of the casting nozzle 10, permitting flow of molten metal downwardly through flow divider 70.

Side walls 76, in conjunction with face walls (not shown) form an exterior surface of casting nozzle 10. Side walls 76 have side wall interior surfaces 78 describing the lateral surface of casting nozzle bore 12. Side walls 76 curve outwardly at the lower end 22 of the casting nozzle.

Two baffles 80 are located in nozzle bore 12 at, or in proximity to, lower end 22 of the casting nozzle bore. Each baffle 80 is located between flow divider 70 and a respective casting nozzle side wall 76. Each baffle 80 divides incident flow of molten metal into a lateral portion in proximity to a side wall 76 and a central portion in proximity to central vertical axis 14. Exit port channels 81, each leading from the interior of the casting nozzle 10 to a respective exit port 26, are defined as the volume between a baffle 80 and a respective side wall interior surface 78, or a baffle 80 and the flow divider 70. Exit port channels 81 located between a baffle 80 and a respective side wall interior surface 78 may be straight, may be free of curved portions, or may have a fixed angle with the central vertical axis 14.

Figure 2:
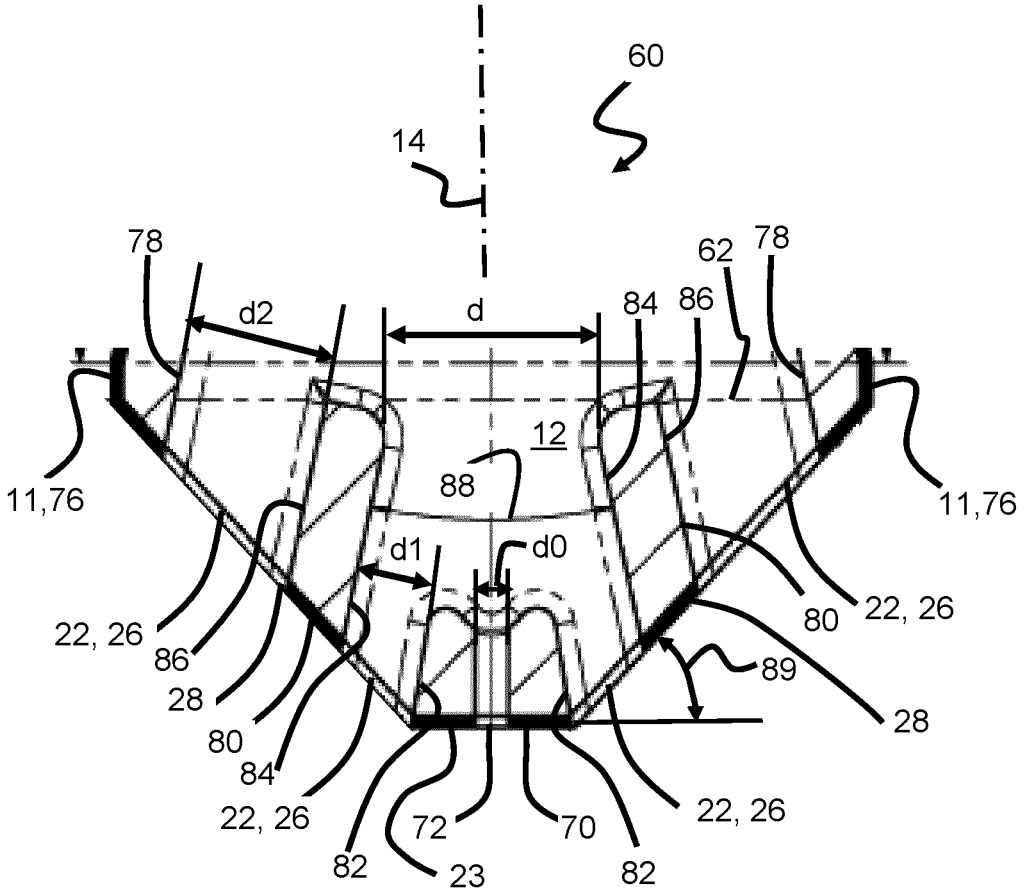
FIG. 2 is a vertical cross section of the adjustment section of a nozzle of the present invention.

FIG. 2 shows a view, along a vertical section extending from one side wall 76 to another side wall 76, of an adjustment section 60 of nozzle bore 12 of a casting nozzle. Adjustment section 60 is bounded above by upper end of adjustment section 62, on each side by a side wall 76, and below by lower end of casting nozzle 23. Lower end of casting nozzle 23 contains a central portion through which central vertical axis of casting nozzle 14 passes. Two exit port faces 28 are disposed symmetrically with respect to central vertical axis of casting nozzle 14. Each exit port face extends from lower end of casting nozzle 23 to a respective side wall 76. Lower end of casting nozzle central portion 23 is contained in a plane that is orthogonal to central vertical axis of casting nozzle 14.

Flow divider 70 extends inwardly, into bore of casting nozzle 12, from lower end of casting nozzle central portion 23. Flow divider 70 is penetrated, from nozzle bore 12 to casting nozzle exterior surface 11, along central vertical axis of casting nozzle 14, by flow divider exit port channel 72. The upper surface of flow divider 70 contains a concavity in which the entry to flow divider exit port channel 72 is contained. Each of a pair of flow divider lateral walls 82 faces away from central vertical axis of casting nozzle 14 towards a respective side of the casting nozzle. In the configuration shown, each flow divider lateral wall 82 contains a planar portion.

In the configuration shown, each baffle 80 is located in the bore of casting nozzle 12 between the flow divider 70 and a respective casting nozzle side wall 76. Each baffle extends from an exit port face 28 to the upper end of the adjustment section 62. Each baffle has a baffle inner lateral wall 84 facing flow divider 70, and a baffle outer lateral wall 86 facing a respective casting nozzle side wall interior 78. In the configuration shown, each baffle lateral wall 84, 86 contains a planar portion. The upward extent of flow divider 70 is less than the upward extent of baffles 80. Baffles 80 extend upwardly to the upper end of adjustment section 62. As the flow divider 70 extends from lower end of the casting nozzle 23, the flow divider 70 and baffles 80 are advantageously entirely located within the adjustment section 60.

In the configuration shown, the planar portion of the casting nozzle side wall interior 78 in adjustment section 60, the baffle outer lateral wall 86, the baffle inner lateral wall 84, and the flow divider lateral wall 82 on a respective side of the casting nozzle are all parallel.

Flow divider exit port channel 72 has a diameter of (d0). The minimum distance between baffles 80 is represented as (d). The minimum distance between each baffle 80 and a respective casting nozzle side wall 78 is represented as (d2). The relationship of d and d2 may be expressed by the formula $(d)/2<d2<2(d)/2$. The minimum distance (d) between baffles 80, the diameter (d0) of the flow divider exit port channel 72, and the minimum distance (d1) between each baffle 80 and the flow divider 70, may be expressed by the formula $0.8(d)/2<((d1)+(d0))<2(d)/2$.

Angle 88 represents the angle between baffle inner lateral walls 84 of respective baffles 80. Angle 88 may have a value may have a value from and including 12 degrees to and including 36 degrees, and may have a value of any of 12, 13, 14, 15, 16, 17, 18, 19, 20, 21, 22, 23, 24, 25, 26, 27, 28, 29, 30, 31, 32, 33, 34, 35, and 36 degrees.

Angle 89 represents the angle between the plane of lower end 23 of the casting nozzle, and the plane of an adjacent exit port face 28. Angle 89 may have a value from and including 30 degrees to and including 60 degrees, from 35 degrees to and including 55 degrees, or may have a value of any of 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, and 60 degrees.

Figure 3:
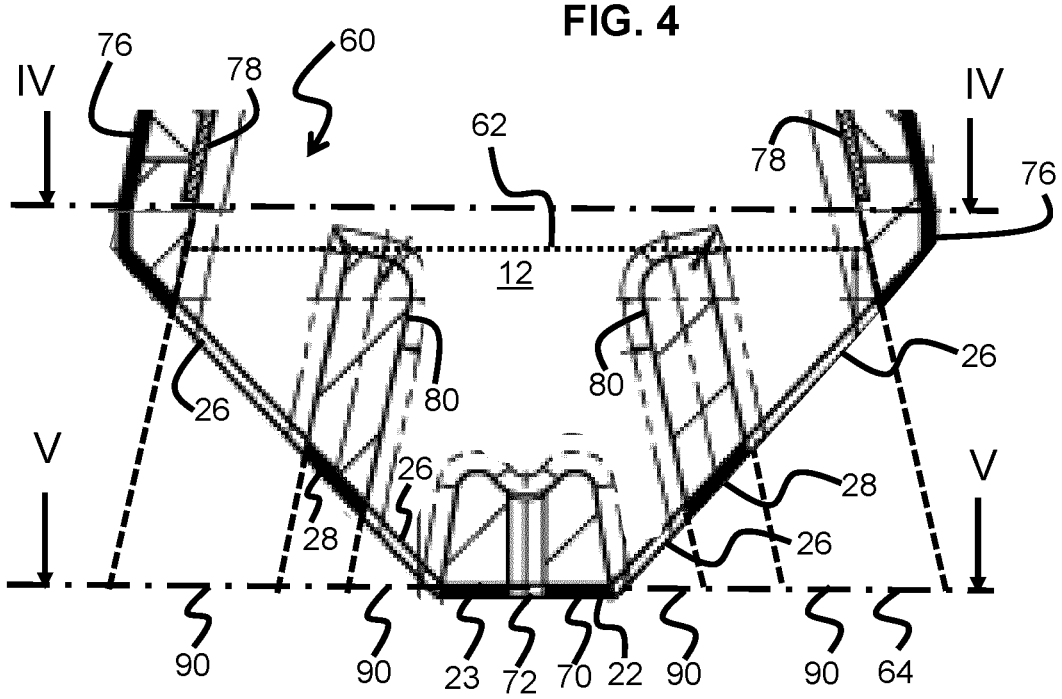
FIG. 3 is a vertical cross section of the adjustment section of a nozzle of the present invention.

FIG. 3 shows a view, along a vertical section extending from one side wall 76 to another side wall 76, of an adjustment section 60 of a casting nozzle. Adjustment section 60 is bounded above by upper end of adjustment section 62, on each side by a side wall 76, and below by lower end of casting nozzle 22. Lower end of casting nozzle 22 contains a lower end of casting nozzle central portion 23, and two exit port faces 28. Each exit port face extends from lower end of casting nozzle 23 to a respective side wall 76.

Flow divider 70 extends inwardly, into bore of casting nozzle 12, from lower end of casting nozzle 23. Flow divider 70 is penetrated vertically by flow divider exit port channel 72.

Baffles 80 are located in the bore of casting nozzle 12 between the flow divider 70 and a respective casting nozzle side wall 76. The upward extent of flow divider 70 is less than the upward extent of baffles 80. Baffles 80 extend upwardly to the upper end of adjustment section 62. As the flow divider 70 extends from lower end of the casting nozzle 23, the flow divider 70 and baffles 80 are therefore advantageously entirely located within the adjustment section 60.

Exit ports 26 are formed in an exit port face 28 between each baffle 80 and a respective casting nozzle side wall interior 78, and between each baffle 80 and flow divider 70.

Exit port projections 90 are the projections of exit ports 26 into the plane of lower end of casting nozzle central portion 23.

Figure 4:
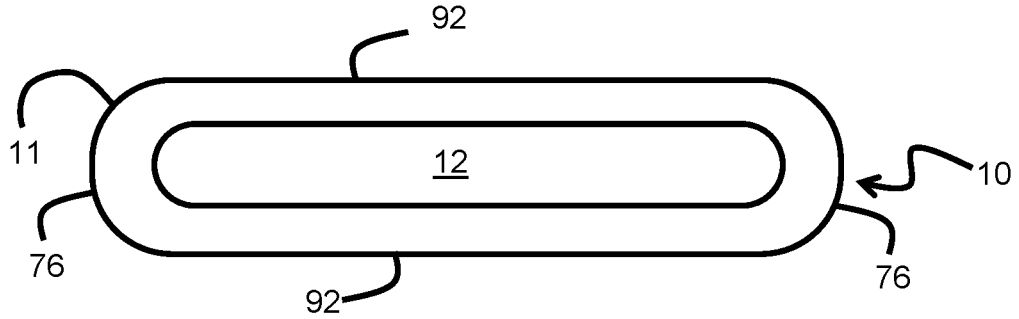
FIG. 4 is a horizontal cross-section of the lower end of the expansion section of a nozzle of the present invention.

FIG. 4 is a horizontal section of casting nozzle 10 at section line IV of FIG. 3. Within casting nozzle exterior surface 11, the cross-sectional area of the bore of casting nozzle 12 is depicted. The bore is enclosed by a pair of opposing casting nozzle side walls 76 and a pair of opposing casting nozzle face walls 92. The horizontal section shown is a slight distance above the upper end of the adjustment section of the casting nozzle.

Figure 5:
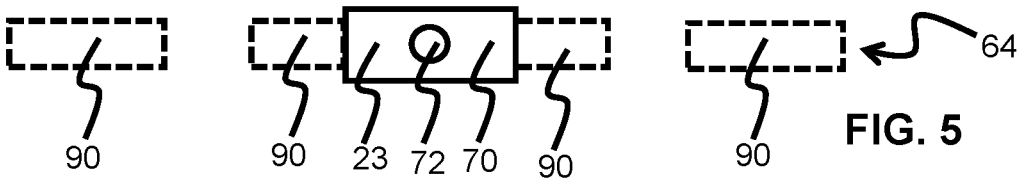
FIG. 5 is a horizontal section of the lower end of a nozzle of the present invention, showing sections of projections of the exit ports.

FIG. 5 is a horizontal section of casting nozzle 10 at section line V of FIG. 3, the lower end of adjustment section 64. The horizontal section contains the lower end of casting nozzle 23, the lower end of flow divider 70, and the exit of flow divider exit port channel 72. For calculation purposes, the cross-sectional area of bore 12 the lower end of adjustment section 64 is taken as the sum of the projections 90 of the cross-sectional areas of exit ports on the plane of the lower end 64 of the adjustment section, and the cross-sectional area of flow divider exit port channel 72.

Figure 6:
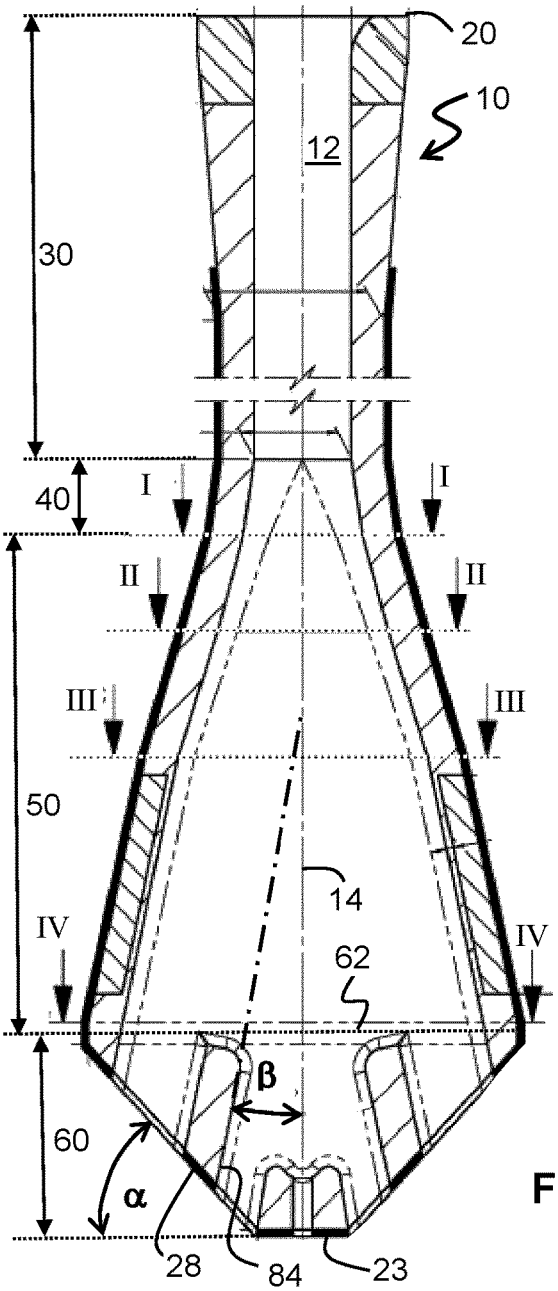
FIG. 6 is a vertical section, from side to side, of a nozzle of the present invention.

FIG. 6 is a view, along a vertical section from one side to another, of a casting nozzle 10. Section line I corresponds to the lower end of the contraction section and the upper end of the expansion section. Section lines II and III are contained within the expansion section. Section line IV corresponds to a section within, and close to the lower end of, the expansion section. Casting nozzle bore 12 contains, extending downwardly from the upper end 20 of casting nozzle 10, entry section 30, contraction section 40, expansion section 50, and adjustment section 60. In the casting nozzle shown, the ratio of the bore width at the upper end 62 of adjustment section 60 to the length of adjustment section 60 has a value of 1.6 and, in other examples, may have a value in the range from and including 1.4 or 1.5 to and including 1.7, 1.8, 1.9, 2.0, 2.1, 2.2, 2.3, 2.4 or 2.5. Angle alpha ($\alpha$) is the angle between exit port face 28 and lower end 23 of the casting nozzle. Angle beta ($\beta$) is the angle between central vertical axis of the casting nozzle 14, and a baffle inner lateral wall 84 on a baffle 80.

Figure 7:
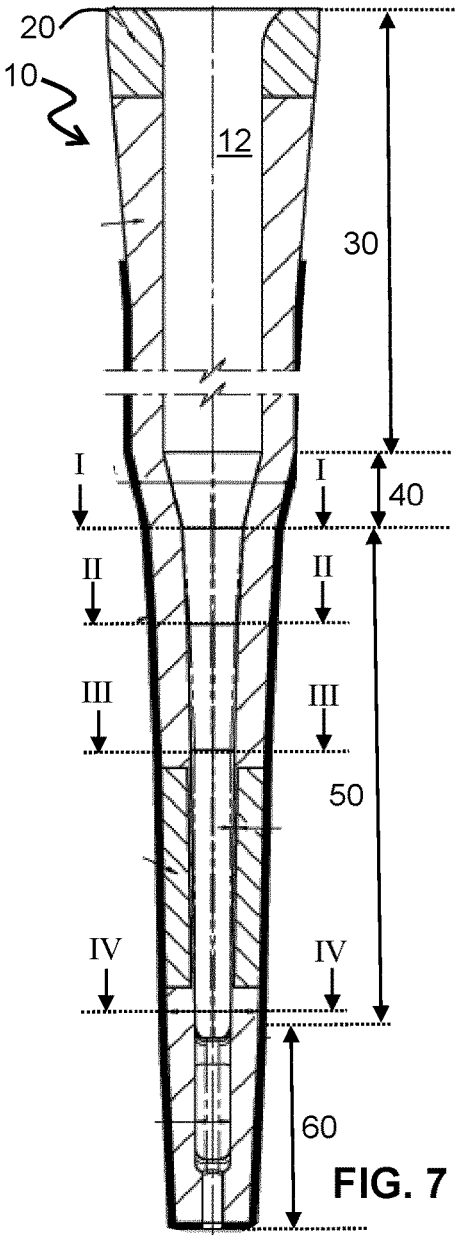
FIG. 7 is a horizontal section, from face to face, of a nozzle of the present invention.

FIG. 7 is a view, along a vertical section from one face to another, of a casting nozzle 10. Section line I corresponds to the lower end of the contraction section and the upper end of the expansion section. Section lines II and III are contained within the expansion section. Section line IV corresponds to a section within, and close to the lower end of, the expansion section. Casting nozzle bore 12 contains, extending downwardly from the upper end 20 of casting nozzle 10, entry section 30, contraction section 40, expansion section 50, and adjustment section 60. In the casting nozzle according to the invention, the contraction section 40 has advantageously a length lower or equal to 15% the total length of the casting nozzle.

In the example depicted in FIG. 6 and FIG. 7, the entry section 30 of casting nozzle bore 12 is cylindrical in shape. Contraction section 40 has a bore cross-sectional area at its lower end that is less than 80% of the bore cross-sectional area at its upper end. The length of contraction section 40 is less than 10% of the overall length of casting nozzle 10. Expansion section 50 has a bore cross-sectional area at its lower end that is greater than 150% of the bore cross-sectional area at its upper end. Furthermore, expansion section 50 has a bore cross-sectional area at its lower end that is greater than 120% of the bore cross-sectional area of the entry section 30. The length of expansion section 50 is greater than 40% and less than 70% of the overall length of casting nozzle 10. Expansion section 50 has a bore width at its lower end that is greater than 200% of the bore width at its upper end.

Fluid entering entry section 30 of casting nozzle bore 12 is turbulent. The passage of the fluid through contraction section 40 reduces the turbulence and produces a limited pressure increase. In expansion section 50, turbulence increases and the velocity average per unit of volume decreases. The passage of the fluid through adjustment section 60 reduces the turbulence and produces a limited pressure increase.

Figure 8:
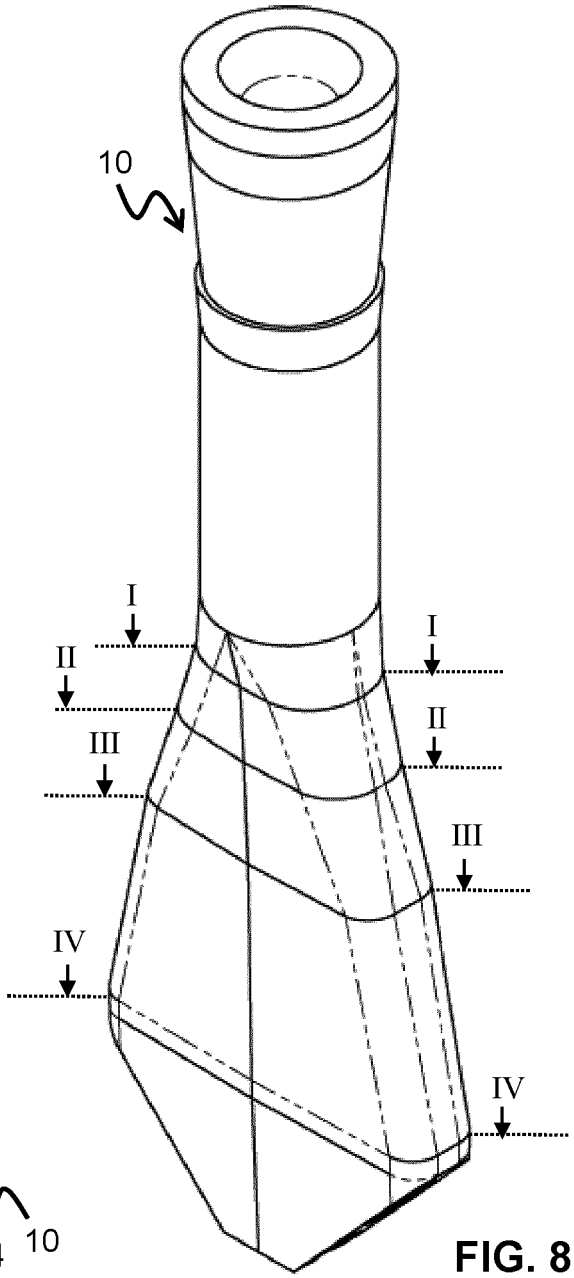
FIG. 8 is a perspective view of a nozzle of the present invention.

FIG. 8 is a perspective view of a casting nozzle 10. Section line I corresponds to the lower end of the contraction section and the upper end of the expansion section. Section lines II and III are contained within the expansion section. Section line IV corresponds to a section within, and close to the lower end of, the expansion section.

Figure 9:
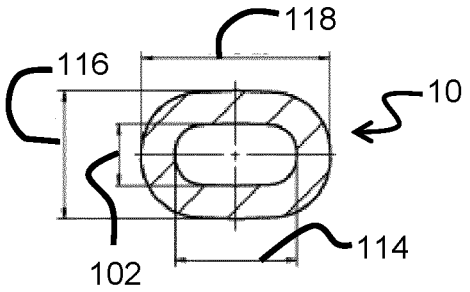
FIG. 9 is a horizontal cross-section of the expansion section of a nozzle of the present invention.

FIG. 9 is a horizontal section of a casting nozzle 10 as depicted in FIGS. 6-8, along section line I. Face-to-face dimension 112 and side-to-side dimension 114 of the bore 12 of casting nozzle 10 are shown. Face-to-face exterior dimension 116 and side-to-side-dimension 118 of casting nozzle 10 are shown. The ratio of dimension 118 to dimension 116 for this horizontal section may have a value of 1.47, a value from and including 1.2 to and including 1.8, or a value from and including 1.1 to and including 2.0.

Figure 10:
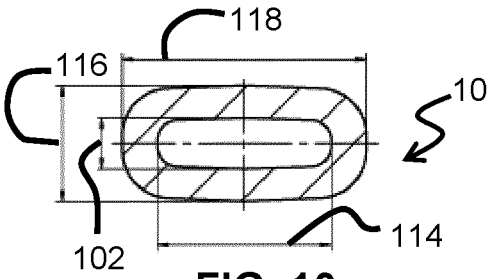
FIG. 10 is a horizontal cross-section of the expansion section of a nozzle of the present invention.

FIG. 10 is a horizontal section of a casting nozzle 10 as depicted in FIGS. 6-8, along section line II. Face-to-face dimension 112 and side-to-side dimension 114 of the bore 12 of casting nozzle 10 are shown. Face-to-face exterior dimension 116 and side-to-side-dimension 118 of casting nozzle 10 are shown. The ratio of dimension 118 to dimension 116 for this section may have a value of 2.10, a value from and including 1.8 to and including 2.4, or a value from and including 1.5 to and including 2.7.

Figure 11:
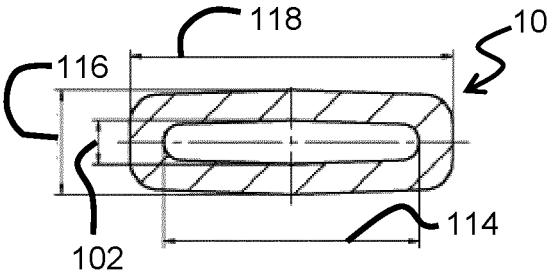
FIG. 11 is a horizontal cross-section of the expansion section of a nozzle of the present invention.

FIG. 11 is a horizontal section of a casting nozzle 10 as depicted in FIGS. 6-8, along section line III. Face-to-face dimension 112 and side-to-side dimension 114 of the bore 12 of casting nozzle 10 are shown. Face-to-face exterior dimension 116 and side-to-side-dimension 118 of casting nozzle 10 are shown. The ratio of dimension 118 to dimension 116 for this section may have a value of 3.05, a value from and including 2.5 to and including 3.5, or a value from and including 2 to and including 4.

Figure 12:
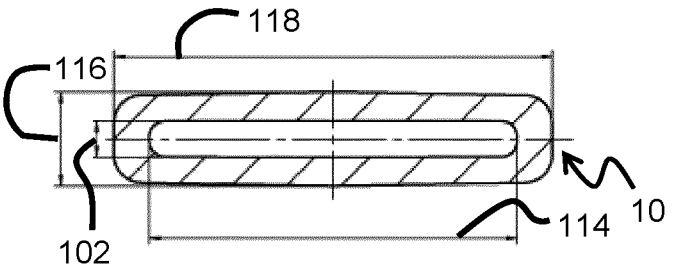
FIG. 12 is a horizontal cross-section of the expansion section of a nozzle of the present invention.

FIG. 12 is a horizontal section of a casting nozzle 10 as depicted in FIGS. 6-8, along section line IV. Section line IV is located on a plane containing the largest exterior width of casting nozzle 10. Face-to-face dimension 112 and side-to-side dimension 114 of the bore 12 of casting nozzle 10 are shown. Face-to-face exterior dimension 116 and side-to-side-dimension 118 of casting nozzle 10 are shown. The ratio of dimension 118 to dimension 116 for this section may have a value of 4.7, a value from and including 4 to and including 6, a value from and including 4 to and including 7, a value from and including 3 to and including 6, a value from and including 3 to and including 7, a value from and including 3 to and including 8, a value from and including 3 to and including 9, a value from and including 2 to and including 6, a value from and including 2 to and including 7, or a value from and including 2 to and including 8.

Figure 13:
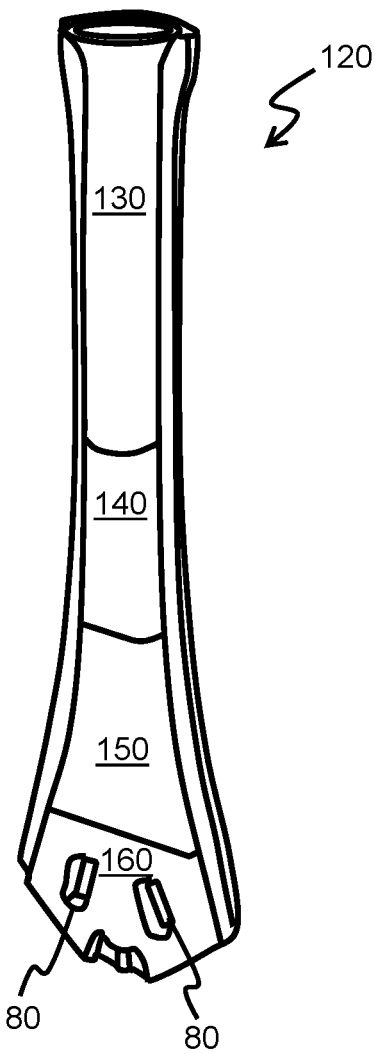
PRIOR ART FIG. 13
FIG. 13 is a perspective view of a comparative example of a nozzle.

FIG. 13 is a perspective view of a casting nozzle comparative example 120 having, in descending order from the upper end, an entry section 130, a transition section 140, an expansion section 150, and an adjustment section 160. In the comparative example, baffles 80 do not extend upwardly to the intersection of the lower end of the expansion section and the upper end of the adjustment section. In the comparative example, baffles 80 do not extend downwardly to the exit port face. In the comparative example, the contraction section of the currently disclosed casting nozzle is replaced with a transition section in which the circular cross-section of the bore in the entry section is transformed to an elongated rectangle with rounded corners.

Figure 14:
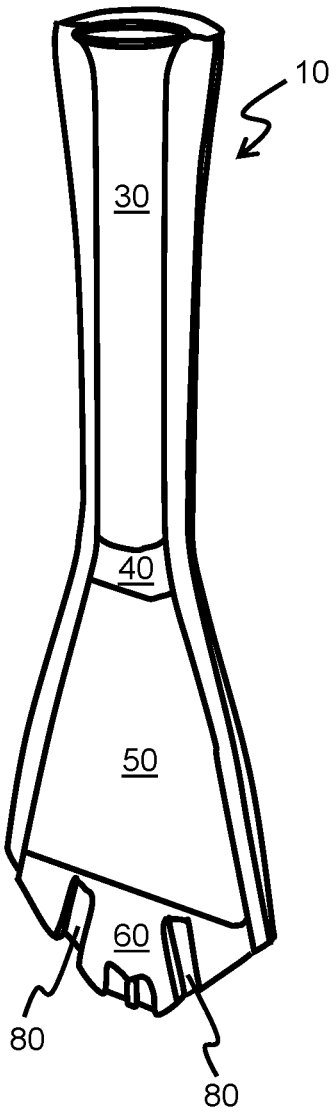
FIG. 14 is a perspective view of a nozzle of the present invention.

FIG. 14 is a perspective view of a casting nozzle 10 having, in descending order from the upper end, an entry section 30, a contraction section 40, an expansion section 50, and an adjustment section 60. In this configuration, baffles 80 extend upwardly to the intersection of the lower end of the expansion section and the upper end of the adjustment section. In this configuration, baffles 80 extend downwardly to the exit port face.

Table I shows cross-sectional areas of the bore of a comparative example of a nozzle according to FIG. 13, and an inventive example of the nozzle according to FIG. 14, as a function of the percentage of the distance from the upper end to the lower end of the nozzle.

TABLE I

Nozzle Bore Cross-sectional Area

| Distance from upper end of the nozzle | Percentage of cross-sectional area of the bore with respect to cross-sectional area of the bore of the entry end of the nozzle | |
|---|---|---|
| | Comparative Example | Inventive Example |
| 0% | 100% | 100% |
| 5% | 100% | 100% |
| 10% | 100% | 100% |
| 15% | 100% | 100% |
| 20% | 100% | 100% |
| 25% | 100% | 100% |
| 30% | 100% | 100% |
| 35% | 100% | 100% |
| 35.6% (start of diffusion region for comparative example) | 100% | 100% |
| 40% | 105.6% | 100% |
| 45% | 111.9% | 100% |
| 48.5% (start of upper constriction region for inventive example) | 116.3% | 100% |
| 50% | 118.2% | 96% |
| 54.3% (start of diffusion region for inventive example) | 123.6% | 85.98% |
| 55% | 124.5% | 90% |
| 56.4% | 126.48% | 92% |
| 60% | 130.8% | 98% |
| 61.6% | 132.9% | 102.62% |
| 65% | 137.2% | 112% |
| 70% | 143.5% | 124% |
| 71.2% | 145.01% | 126.88% |
| 75% | 148.7% | 135% |
| 79.33% (start of constriction region for comparative example) | 152.80% | 142% |
| 80% | 152.16% | 144% |
| 85% | 147.34% | 154% |
| 86.7% (start of increase in constriction rate for comparative example) | 145.37% | 157% |
| 87.5% (local minimum of cross-sectional volume for comparative example) | 132.54% | 159% |
| 89.2% | 138.16% | 162% |
| 90% | 142% | 164% |
| 90.75% (start of constant cross-section for comparative example) | 145.21% | 165% |
| 91.33% (diffusion maximum; start of constriction region for inventive example) | 145.21% | 165.93% |
| 95% | 145.21% | 140% |
| 100% | 145.21% | 105% |

Table II shows volume weighted averages of velocity U in meters/second and turbulence intensity Tu as a percentage in a nozzle comparative example and a nozzle inventive example.

TABLE II

Velocity and Turbulence Intensity of Molten Metal in Nozzle

| Region | Example of Innovation | | Comparative Example | |
|---|---|---|---|---|
| | U [m/s] | Tu [%] | U [m/s] | Tu [%] |
| 130, 30 | 2.36 | 19.82 | 2.39 | 22.59 |
| 140, 40 | 2.40 | 7.87 | 2.19 | 8.63 |
| 150, 50 | 1.76 | 7.36 | 1.97 | 6.04 |
| 160, 60 | 1.48 | 7.56 | 1.80 | 5.67 |

In the nozzle comparative example, a continuous decrease in velocity and turbulence is produced as the fluid passes through volumes 130, 140, 150 and 160. In the nozzle inventive example, an increase in velocity is produced in volume 40, and an increase in turbulence is produced in volume 60.

Table III shows volume ΔV in cubic meters, velocity per unit volume U/ΔV, and turbulent energy per unit volume k/ΔV in a nozzle comparative example and a nozzle inventive example.

TABLE III

Volume, Velocity per Unit Volume, Turbulent Energy per Unit Volume in Nozzle

| Region | Example of Innovation | | | Comparative Example | | |
|---|---|---|---|---|---|---|
| | ΔV [$m^3$] | U/ΔV | k/ΔV | ΔV [$m^3$] | U/ΔV | k/ΔV |
| 130, 30 | 0.003674 | 641.24 | 35.61 | 0.002919 | 817.19 | 50.86 |
| 140, 40 | 0.000421 | 5698.45 | 126.84 | 0.001619 | 1355.12 | 33.61 |
| 150, 50 | 0.003587 | 491.18 | 7.21 | 0.002190 | 898.37 | 10.49 |
| 160, 60 | 0.001173 | 1264.95 | 12.96 | 0.001448 | 1245.53 | 8.54 |

In both the nozzle comparative example and the nozzle innovative example, values of U/ΔV increase, decrease, and increase again with passage through volumes 130/30, 140/40, 150/50 and 160/60, but the changes are more pronounced in the nozzle innovative example.

In the nozzle comparative example, values of k/ΔV show a continuous decrease with passage through volumes 130, 140, 150 and 160. In the nozzle innovative example, values of k/ΔV increase, decrease, and increase again with passage through volumes 30, 40, 50 and 60.

One transition from turbulent flow to aligned flow occurs within the comparative example nozzle. Two transitions from turbulent flow to aligned flow occur within the inventive example nozzle.

Figure 15:
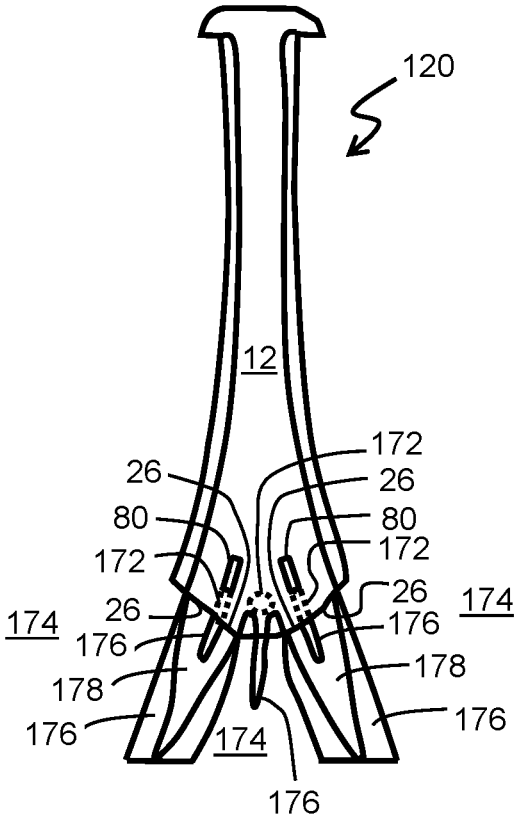
PRIOR ART FIG. 15
FIG. 15 is a front elevation of a comparative example of a nozzle and exiting flow.

FIG. 15 is a face view diagram of a casting nozzle comparative example 120 showing, within the nozzle, volumes in which flow velocities are decreased and pressures are increased 172. Below the nozzle, low flow velocity volumes 174, moderate flow velocity volumes 176, and high flow velocity volumes 178 are indicated. Flow in casting nozzle bore 12 is directed by baffles 80 and passes through exit ports 26.

Figure 16:
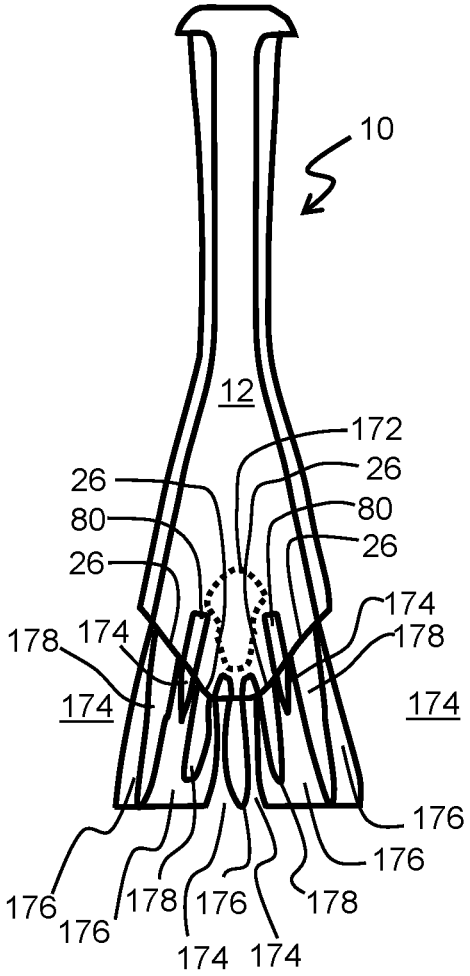
FIG. 16 is a front elevation of a nozzle of the present invention and exiting flow.

FIG. 16 is a face view diagram of casting nozzle 10 showing, within the nozzle, volumes in which flow velocities are decreased and pressures are increased 172. Below the nozzle, low flow velocity volumes 174, moderate flow velocity volumes 176, and high flow velocity volumes 178 are indicated. Flow in casting nozzle bore 12 is directed by baffles 80 and passes through exit ports 26.

In casting nozzle 10, a low velocity (higher pressure) volume is observed above the flow divider and between the baffles. The pressure forces the flow between each side of the piece and a respective baffle.

Table IV shows velocity U in meters per second and bore cross-sectional area in square meters for a nozzle comparative example and a nozzle inventive example.

TABLE IV

Velocity and Bore Cross-sectional Area in Nozzle

| | Comparative Example | | Example of Innovation | |
|---|---|---|---|---|
| Y [m] | U [m/s] | Area [$m^2$] | U [m/s] | Area [$m^2$] |
| 1.00 | 4.28 | 0.0046 | 4.00 | 0.0046 |
| 0.95 | 2.48 | 0.0063 | 2.44 | 0.0064 |
| 0.90 | 2.27 | 0.0063 | 2.24 | 0.0064 |
| 0.85 | 2.25 | 0.0063 | 2.21 | 0.0064 |
| 0.80 | 2.24 | 0.0063 | 2.21 | 0.0064 |
| 0.75 | 2.24 | 0.0063 | 2.20 | 0.0064 |
| 0.70 | 2.24 | 0.0063 | 2.20 | 0.0064 |
| 0.65 | 2.24 | 0.0063 | 2.19 | 0.0064 |
| 0.60 | 2.24 | 0.0063 | 2.19 | 0.0064 |
| 0.55 | 2.24 | 0.0063 | 2.18 | 0.0064 |
| 0.50 | 2.22 | 0.0064 | 2.18 | 0.0064 |
| 0.45 | 2.20 | 0.0065 | 2.17 | 0.0064 |
| 0.40 | 2.18 | 0.0065 | 2.19 | 0.0063 |
| 0.35 | 2.18 | 0.0065 | 2.40 | 0.0057 |
| 0.30 | 2.19 | 0.0065 | 2.26 | 0.0061 |
| 0.25 | 2.12 | 0.0067 | 2.03 | 0.0066 |
| 0.20 | 2.03 | 0.0070 | 1.88 | 0.0074 |
| 0.15 | 1.97 | 0.0072 | 1.76 | 0.0079 |
| 0.10 | 1.95 | 0.0073 | 1.65 | 0.0085 |
| 0.05 | 1.88 | 0.0076 | 1.55 | 0.0090 |
| 0.00 | 1.86 | 0.0077 | 1.47 | 0.0096 |
| −0.05 | 1.79 | 0.0081 | 1.38 | 0.0101 |
| −0.10 | 2.14 | 0.0068 | 1.31 | 0.0105 |
| −0.15 | 1.85 | 0.0079 | 1.54 | 0.0088 |
| −0.20 | 1.48 | 0.0055 | 1.20 | 0.0060 |
| −0.25 | 1.43 | 0.0005 | 1.59 | 0.0029 |
| −0.30 | | | 1.31 | 0.0005 |

Two compression sections and two expansion sections are seen to provide, in combination with one or more of cooperating baffle configurations and orientations, ratios of exit port cross-sections in comparison with other nozzle bore cross-sections, nozzle bore cross-sectional geometries and values, and selected values and ratios of values of the sections of the nozzle bore, an increased flow stability and improved flow distribution in the fluid passing through the exit ports with respect to previous designs. The flow pattern exhibits less deflection and does not coalesce into single high intensity streams. It retains a laminar planar structure and is therefore suited to even distribution of molten metal into a mold in which one dimension of cross-section is significantly larger than the other.

Various features and characteristics are described in this specification and illustrated in the drawings to provide an overall understanding of the invention. It is understood that the various features and characteristics described in this specification and illustrated in the drawings can be combined in any operable manner regardless of whether such features and characteristics are expressly described or illustrated in combination in this specification. The Inventors and the Applicant expressly intend such combinations of features and characteristics to be included within the scope of this specification, and further intend the claiming of such combinations of features and characteristics to not add matter to the application. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims, and will comply with written description, sufficiency of description, and added matter requirements (e.g., 35 U.S.C. § 112(a) and Article 123(2) EPC). The invention can comprise, consist of, or consist essentially of the various features and characteristics described in this specification.

Also, any numerical range recited in this specification includes the recited endpoints and describes all sub-ranges of the same numerical precision (i.e., having the same number of specified digits) subsumed within the recited range. For example, a recited range of "1.0 to 10.0" describes all sub-ranges between (and including) the recited minimum value of 1.0 and the recited maximum value of 10.0, such as, for example, "2.4 to 7.6," even if the range of "2.4 to 7.6" is not expressly recited in the text of the specification. Accordingly, the Applicant reserves the right to amend this specification, including the claims, to expressly recite any sub-range of the same numerical precision subsumed within the ranges expressly recited in this specification. All such ranges are inherently described in this specification such that amending to expressly recite any such sub-ranges will comply with written description, sufficiency of description, and added matter requirements (e.g., 35 U.S.C. § 112(a) and Article 123(2) EPC).

The grammatical articles "one", "a", "an", and "the", as used in this specification, are intended to include "at least one" or "one or more", unless otherwise indicated or required by context. Thus, the articles are used in this specification to refer to one or more than one (i.e., to "at least one") of the grammatical objects of the article. By way of example, "a component" means one or more components, and thus, possibly, more than one component is contemplated and can be employed or used in an implementation of the invention. Further, the use of a singular noun includes the plural, and the use of a plural noun includes the singular, unless the context of the usage requires otherwise.

LIST OF ELEMENTS

10. Casting Nozzle
11. Casting nozzle exterior surface
12. Bore of casting nozzle
14. Central vertical axis of casting nozzle
20. Upper end of casting nozzle bore
22. Lower end of casting nozzle bore
23. Lower end of casting nozzle
24. Entry port
26. Exit port
28. Exit port face
30. Entry section
32. Upper end of entry section
34. Lower end of entry section
40. Contraction section
42. Upper end of contraction section
44. Lower end of contraction section
50. Expansion section
52. Upper end of expansion section
54. Lower end of expansion section
60. Adjustment section
62. Upper end of adjustment section
64. Lower end of adjustment section
70. Flow divider
72. Flow divider exit port channel
76. Casting nozzle side wall
78. Casting nozzle side wall interior

80. Baffle
81. Exit port channel
82. Flow divider lateral wall
84. Baffle inner lateral wall
86. Baffle outer lateral wall
88. Angle between baffle inner lateral walls 84
89. Angle between casting nozzle lower end and exit port face
90. Exit port projection
92. Casting nozzle face wall
112. Face-to-face bore dimension
114. Side-to-side bore dimension
116. Face-to-face nozzle exterior dimension
118. Side-to-side nozzle exterior dimension
120. Casting nozzle comparative example
130. Entry section of comparative example
140. Transition section of comparative example
150. Expansion section of comparative example
160. Adjustment section of comparative example
172. Decreased flow velocity volume
174. Low flow velocity volume
176. Moderate flow velocity volume
178. High flow velocity volume

The invention claimed is:

1. A casting nozzle for flowing liquid therethrough comprising:

a lower end;

an exterior surface;

an elongated bore having a central vertical axis, an upper end and a lower end, at least one entry port disposed at the upper end and at least one exit port disposed at the lower end;

wherein the bore comprises:

a) an entry section disposed at the upper end of the bore, the entry section having an upper end, a lower end, a length, and a uniform cross-sectional area;

b) a contraction section disposed below, and in direct communication with, the entry section; the contraction section having an upper end, a lower end, a length, a cross-sectional area at the upper end being equal to the cross-sectional area of the entry section, and a cross-sectional area that decreases from the upper end to the lower end of the contraction section;

c) an expansion section disposed below, and in direct communication with, the contraction section; the expansion section having an upper end, a lower end, a length, a cross-sectional area at the upper end being equal to the cross-sectional area of the lower end of the contraction section and less than the cross-sectional area of the entry section, a cross sectional area that increases from the upper end to the lower end; and a cross-sectional area at the lower end being greater than the cross-sectional area of the entry section;

d) an adjustment section disposed below, and in direct communication with, the expansion section; the adjustment section having an upper end, a lower end, a length, a cross-sectional area at the upper end being equal to the cross-sectional area of the of the lower end of the expansion section and greater than the cross-sectional area of the entry section, a cross-sectional area that decreases from the upper end to the lower end; and a cross-sectional area at the lower end in a range from and including 80% to and including 120% of the cross-sectional area of the entry section, characterized in that the cross-sectional area of the bore at the lower end of the casting nozzle is a sum of (a) a cross-sectional area of each exit port in a plane orthogonal to the central vertical axis and containing the lower end of the casting nozzle, and (b) a projected cross-sectional area, in the plane orthogonal to the central vertical axis, of each exit port not extending to the plane orthogonal to the central vertical axis and containing the lower end of the casting nozzle;

wherein the expansion section and the adjustment section of the bore comprise a pair of opposing face walls having interiors and exteriors and a pair of opposing side walls having interiors and exteriors;

and wherein the casting nozzle also comprises:

a flow divider disposed within the bore, at the lower end of the casting nozzle, on the central vertical axis of the bore, between the pair of opposing face walls; and a pair of baffles positioned within the bore, each baffle positioned between the flow divider and a respective side wall, the lower end of each baffle forming a portion of the exterior surface of the casting nozzle, each baffle extending inwardly from at least one face wall, the pair of baffles being positioned symmetrically with respect to the central vertical axis of the bore;

wherein the flow divider comprises a pair of lateral walls; each lateral wall facing a respective adjustment section side wall, the pair of lateral walls being positioned symmetrically with respect to the central vertical axis of the bore;

wherein the flow divider comprises a flow divider exit port channel extending from the adjustment section to the exterior surface of the casting nozzle, the flow divider exit port channel having a diameter of d0;

wherein each baffle comprises an outward-facing longitudinal wall and an inward-facing longitudinal wall;

wherein an outward-facing wall of each baffle defines, in conjunction with a respective casting nozzle side wall interior and the interiors of the opposing face walls, a lateral exit port;

wherein an inward-facing wall of each baffle defines, in conjunction with a respective lateral wall of the flow divider and the interiors of the opposing face walls, a central exit port;

wherein an upward extent of flow divider is less than an upward extent of baffles;

wherein the baffles extend upwardly to the upper end of adjustment section;

wherein a relationship between a minimum distance (d) between the baffles, and a minimum distance (d2) between each baffle and the respective casting nozzle side wall interior, is expressed by formula $$(d)/2<d2<2(d)/2; \text{ and}$$

wherein a relationship among the minimum distance between the baffles (d), a diameter (d0) of the flow divider exit port channel, and a minimum distance between each baffle and the flow divider (d1), is expressed by formula $$0.8(d)/2<((d1)+(d0))<2(d)/2.$$

2. The casting nozzle of claim 1, characterized in that a minimum cross-sectional area of the contraction section has a value in the range from and including 60% to and including 90% of the cross-sectional area of the entry section.

3. The casting nozzle of claim 1, characterized in that a maximum cross-sectional area of the expansion section has a value in the range from and including 150% to and including 200% of the cross-sectional area of the entry section.

4. The casting nozzle of claim 1, characterized in that a distance between the opposing side walls is greater than the distance between the opposing face walls, characterized that the distance between opposing face wall exteriors defines a depth of the casting nozzle, characterized that the distance between opposing side wall exteriors defines a width of the casting nozzle; and characterized in that the distance between the opposing side walls increases from the upper end to the lower end of the expansion section.

5. The casting nozzle of claim 4, characterized in that the distance between the opposing side walls increases by at least a factor of 2 from the upper end of the expansion section to the lower end of the expansion section.

6. The casting nozzle of claim 4, characterized in that an intersection of each side wall with the lower end of the casting nozzle is beveled to form beveled surfaces.

7. The casting nozzle of claim 6, wherein the beveled surfaces form an angle (alpha) with the plane orthogonal to the central vertical axis and containing a portion of the lower end of the casting nozzle, characterized in that alpha has a value in the range from and including 30 degrees to and including 60 degrees.

8. The casting nozzle of claim 7, characterized in that the angle (beta) described, in a vertical plane orthogonal to an outward-facing longitudinal surface of each baffle, by an inward-facing longitudinal surface of each baffle and the central vertical axis of the bore of the casting nozzle, has a value from and including 6 degrees to and including 18 degrees.

9. The casting nozzle of claim 4, wherein a ratio of a bore width at the upper end of the adjustment section to the length of the adjustment section has a value from and including 1.4 to and including 2.5.

10. The casting nozzle of claim 1, characterized in that the flow divider comprises a concave upper surface.

11. The casting nozzle of claim 1, characterized in that the length of the contraction section has a value from and including 5% to and including 15% of the length of the casting nozzle.

12. The casting nozzle of claim 1, characterized in that the length of the expansion section has a value from and including 40% to and including 70% of the length of the casting nozzle.

13. The casting nozzle of claim 1, characterized in that the length of the adjustment section has a value from and including 5% to and including 15% of the length of the casting nozzle.

14. The casting nozzle of claim 1, characterized in that an outward-facing longitudinal surface of each baffle, an inward-facing longitudinal surface of each baffle, a corresponding lateral wall of the flow divider, and the respective casting nozzle side wall interior of the corresponding side wall are parallel, and characterized in that the outward-facing longitudinal surfaces of each baffle do not curve outwardly from the upper end of the baffle to the lower end of the baffle.

* * * * *